US010779369B2

(12) United States Patent
Cahalane et al.

(10) Patent No.: US 10,779,369 B2
(45) Date of Patent: Sep. 15, 2020

(54) LIGHT FIXTURE WITH LEDS OF MULTIPLE DIFFERENT WAVELENGTHS

(71) Applicant: Electronic Theatre Controls, Inc., Middleton, WI (US)

(72) Inventors: David J. Cahalane, Dane, WI (US); Gary Bewick, Cross Plains, WI (US); Wendy Luedtke, Brooklyn, NY (US); Fred Foster, Verona, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 53 days.

(21) Appl. No.: 16/151,500

(22) Filed: Oct. 4, 2018

(65) Prior Publication Data

US 2020/0113022 A1 Apr. 9, 2020

(51) Int. Cl.

| | |
|---|---|
| ***H05B 33/08*** | (2020.01) |
| ***F21K 9/64*** | (2016.01) |
| ***F21V 7/00*** | (2006.01) |
| ***F21V 5/00*** | (2018.01) |
| ***H05B 45/20*** | (2020.01) |

(Continued)

(52) U.S. Cl.

CPC ..... *H05B 45/20* (2020.01); *F21K 9/64* (2016.08); *F21V 5/007* (2013.01); *F21V 7/0091* (2013.01); *F21Y 2105/10* (2016.08); *F21Y 2113/13* (2016.08); *F21Y 2115/10* (2016.08)

(58) Field of Classification Search

CPC ..... H05B 45/20; F21K 9/64; F21V 7/0091; F21V 5/007; F21Y 2105/10; F21Y 2113/13; F21Y 2115/10

See application file for complete search history.

(56) References Cited

U.S. PATENT DOCUMENTS

| | | | |
|---|---|---|---|
| 8,384,294 | B2 | 2/2013 | Hatley et al. |
| 8,403,523 | B2 | 3/2013 | Gerlach et al. |

(Continued)

FOREIGN PATENT DOCUMENTS

| | | | |
|---|---|---|---|
| GB | 2577787 | A | 4/2020 |
| WO | 2012/140589 | A2 | 10/2012 |

OTHER PUBLICATIONS

Stic Report U.S. Appl. No. 16/151,500 611150 (Year: 2019).*

(Continued)

*Primary Examiner* — Tracie Y Green

(74) *Attorney, Agent, or Firm* — Michael Best and Friedrich LLP

(57) ABSTRACT

An LED light fixture comprising a plurality of LEDs mounted on a substrate, wherein the plurality of LEDs include a lime/mint light source accounting for at least 25% of the total lumen output, and a deep red light source accounting for at least 0.5% of total lumen output. The lime/mint light source preferably accounts for at least 50% of the total lumen output. The deep red light source preferably accounts for at least 1.0% of the total lumen output. The light fixture can also include other colors, such as 1% to 50% cyan, 1% to 20% red/red-orange, and 1% to 10% blue/indigo. In one embodiment, the fixture further includes a processor for calculating a color mix and driving the LEDs. Preferably, the processor is programmed to produce a color mix having a CCT in the range of 2700-6500K, a TM-30 ($R_f$) of at least 90, and a TLCI of at least 95.

20 Claims, 5 Drawing Sheets

(51) Int. Cl.

| | |
|---|---|
| *F21Y 113/13* | (2016.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 8,593,074 | B2 | 11/2013 | Hatley et al. | |
| 8,723,450 | B2 | 5/2014 | Hatley et al. | |
| 9,380,671 | B1 | 6/2016 | Janos et al. | |
| 9,515,056 | B2 * | 12/2016 | van de Ven | H01L 25/0753 |
| 9,599,294 | B2 * | 3/2017 | Rosenauer | H05B 45/20 |
| 9,814,114 | B2 | 11/2017 | Campetella | |
| 10,219,345 | B2 * | 2/2019 | Yan | H01L 33/483 |
| 2004/0218387 | A1 * | 11/2004 | Gerlach | F21K 9/00 362/231 |
| 2006/0018118 | A1 * | 1/2006 | Lee | H05B 45/20 362/231 |
| 2010/0188022 | A1 | 7/2010 | Gerlach et al. | |
| 2012/0140463 | A1 | 6/2012 | Kinzer et al. | |
| 2013/0088142 | A1 | 4/2013 | Allen | |
| 2015/0054415 | A1 * | 2/2015 | Maxik | A61M 21/02 315/192 |
| 2015/0316218 | A1 | 11/2015 | Harbers et al. | |
| 2017/0223786 | A1 | 8/2017 | Petluri et al. | |
| 2018/0338362 | A1 * | 11/2018 | Petluri | H05B 45/24 |
| 2019/0055468 | A1 * | 2/2019 | Oepts | C09K 11/08 |

OTHER PUBLICATIONS

M. Chakrabarti et al., "High-Flux Focusable Color-Tunable and Efficient White-Light-Emitting Diode Light Engine for Stage Lighting," Optical Engineering, vol. 55(8), pp. 085101-1-085101-12 (Aug. 2016).

ETC, Source Four LED Studio HD Spec, Electronic Theatre Controls, ETC, dated Mar. 2018, Website:https://www.etconnect.com/WorkArea/DownloadA.sset.aspx?id= I 0734 62149, (6 pages).

* cited by examiner

LIGHT FIXTURE WITH LEDS OF MULTIPLE DIFFERENT WAVELENGTHS

BACKGROUND

The present invention relates to light fixtures and particularly to light fixtures having multiple different wavelengths of LEDs.

Luminaires or light fixtures are capable of reproducing a wide gamut of colors by combining light from, for example, a plurality of LED light sources. White is a color that is commonly desired to be produced by a luminaire. To produce white, it is common to energize all LEDs in the luminaire so that white light with the highest luminous flux is produced.

When creating white light from LEDs, it is often characterized by the Correlated Color Temperature (CCT) from warm white (around 2500K) to cool white (around 5000K). In general, warm white is produced using less blue light and more red light, and cool white is produced using more blue light and less red light.

In addition to color temperature, light can be characterized by its ability to accurately render color on a subject. The Color Rendering Index (CRI) provides a representation of an artificial light's accuracy of producing the full range of colors in a subject in comparison to a standardized source (typically a source representing an incandescent lamp or daylight). A perfect CRI score is 100, which indicates that the artificial light source renders color to the human eye as well as the standardized source.

A newer method to evaluate color rendition is TM-30 ($R_f$), which includes a system for evaluating the fidelity of a light source when compared to a reference tungsten halogen source or to daylight. TM-30 ($R_f$) is determined using a well-defined process, such as is described in IES TM-30-15 published by the Illuminating Engineering Society (IES). In particular the ($R_f$) metric defined in TM-30 is a measure of rendering color fidelity.

In a setting in which cameras (e.g., still cameras or video cameras) are being used, light selection must take into account the fact that cameras do not see light the same way as the human eye. This is particularly true for digital cameras that utilize CCD or CMOS sensors as the imaging-capturing interface. Due to this difference in the human eye observer and the digital camera, subjects, such as human skin tones, when illuminated by a light with a high CRI or TM-30 ($R_f$) (which looks good to a human observer) can appear quite poor to a digital camera.

In order to predict a light's ability to accurately render color when captured by a television camera and viewed on a display, the Television Light Consistency Index (TLCI) was created by the European Broadcasting Union (EBU). The TLCI is based on a mathematical calculation implemented in software called TLCI-2012, which is specified in EBU Tech 3355. Like the CRI, the TLCI indexes light up to a maximum score of 100. In general, when recording on a camera in a studio setting, a higher TLCI is considered desirable.

SUMMARY

Historically, the selection of light sources (e.g., LEDs of different wavelengths) in a luminaire is based on the environment in which it will be used. For example, if a luminaire will be used for a live performance, the selection of light sources will be consistent with the production of light that produces the best color rendering for a live performance, which is generally consistent with a high TM-30 ($R_f$) score. Similarly, if a luminaire will be used for a televised studio performance, the selection of light sources will be consistent with the production of light that produces the best color rendering for a studio performance, which is generally consistent with a high TLCI score. Conflicts can arise when a particular luminaire is used for a studio performance with a live audience.

The present invention provides an LED light fixture comprising a substrate and a plurality of LEDs mounted on the substrate, wherein the plurality of LEDs include a lime/mint light source accounting for at least 25% of the total lumen output, and a deep red light source accounting for at least 0.5% of total lumen output. The lime/mint light source preferably accounts for at least 35% (more preferably at least 50% and even more preferably at least 70%) of the total lumen output. In a preferred embodiment, the lime/mint light source accounts for at least 80% of the total lumen output.

The deep red light source preferably accounts for at least 0.75% (more preferably at least 1.0% and even more preferably at least 1.5%) of the total lumen output. In a preferred embodiment, the deep red light source accounts for at least 2.0% of the total lumen output.

The LED light fixture can further comprise a cyan light source that accounts for 1% to 50% of the total lumen output. For example, the cyan light source can account for 1% to 30% (preferably 1% to 20%, more preferably 2% to 15%) of the total lumen output. In a preferred embodiment, the cyan light source accounts for 2% to 10% of the total lumen output.

The LED light fixture can further comprise a red/red-orange light source that accounts for 1% to 20% of the total lumen output. For example, the red/red-orange light source can account for 2% to 15% (preferably 3% to 12%, more preferably 5% to 10%) of the total lumen output.

The LED light fixture can further comprise a blue/indigo light source that accounts for 1% to 10% of the total lumen output. For example, the blue/indigo light source can account for 2% to 5% (preferably 3% to 4%) of the total lumen output.

In one embodiment of the invention, the fixture further includes a processor for calculating a color mix and driving the LEDs. Preferably, the processor is programmed to produce a color mix having a CCT in the range of 2700-6500K, a TM-30 ($R_f$) of at least 90, and a TLCI of at least 95. For example, at a CCT of about 6500K, the TM-30 ($R_f$) is at least 92 and the TLCI is at least 95, and at a CCT of about 5000K, the TM-30 ($R_f$) is at least 92, and the TLCI is at least 95.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
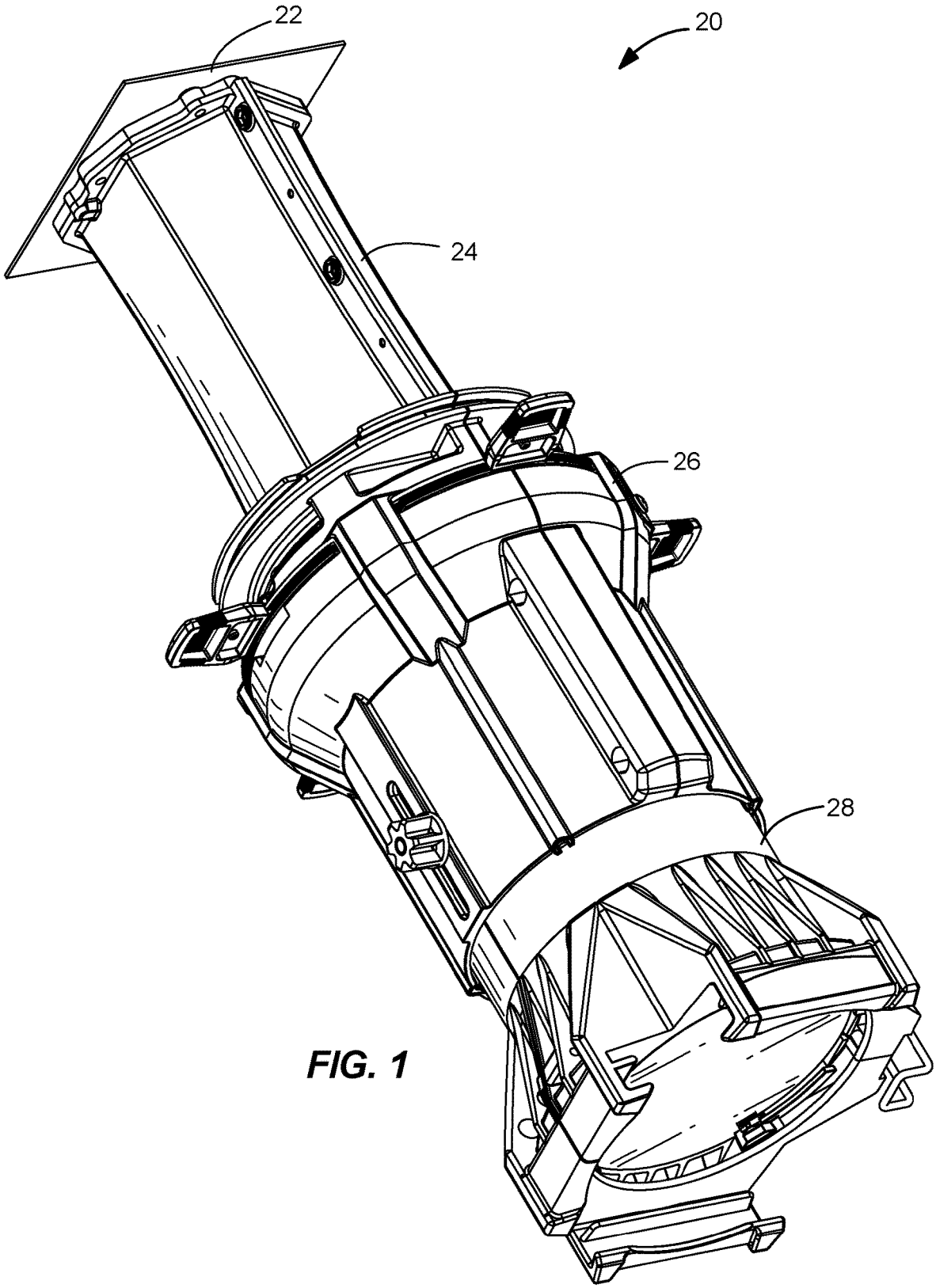
FIG. 1 is a perspective view of an LED luminaire having an LED light source embodying the present invention.

The lighting fixture 20 illustrated FIG. 1 is a luminaire that can be used for entertainment lighting, such as in a theatre or studio. The lighting fixture 20 includes a light source 22 that produces light, a mixing assembly 24 that mixes the light, a gate assembly 26 through which the light passes after exiting the mixing assembly 24, and a lens assembly 28 that receives the light from the gate assembly 26 and projects it toward the desired location.

Figure 2:
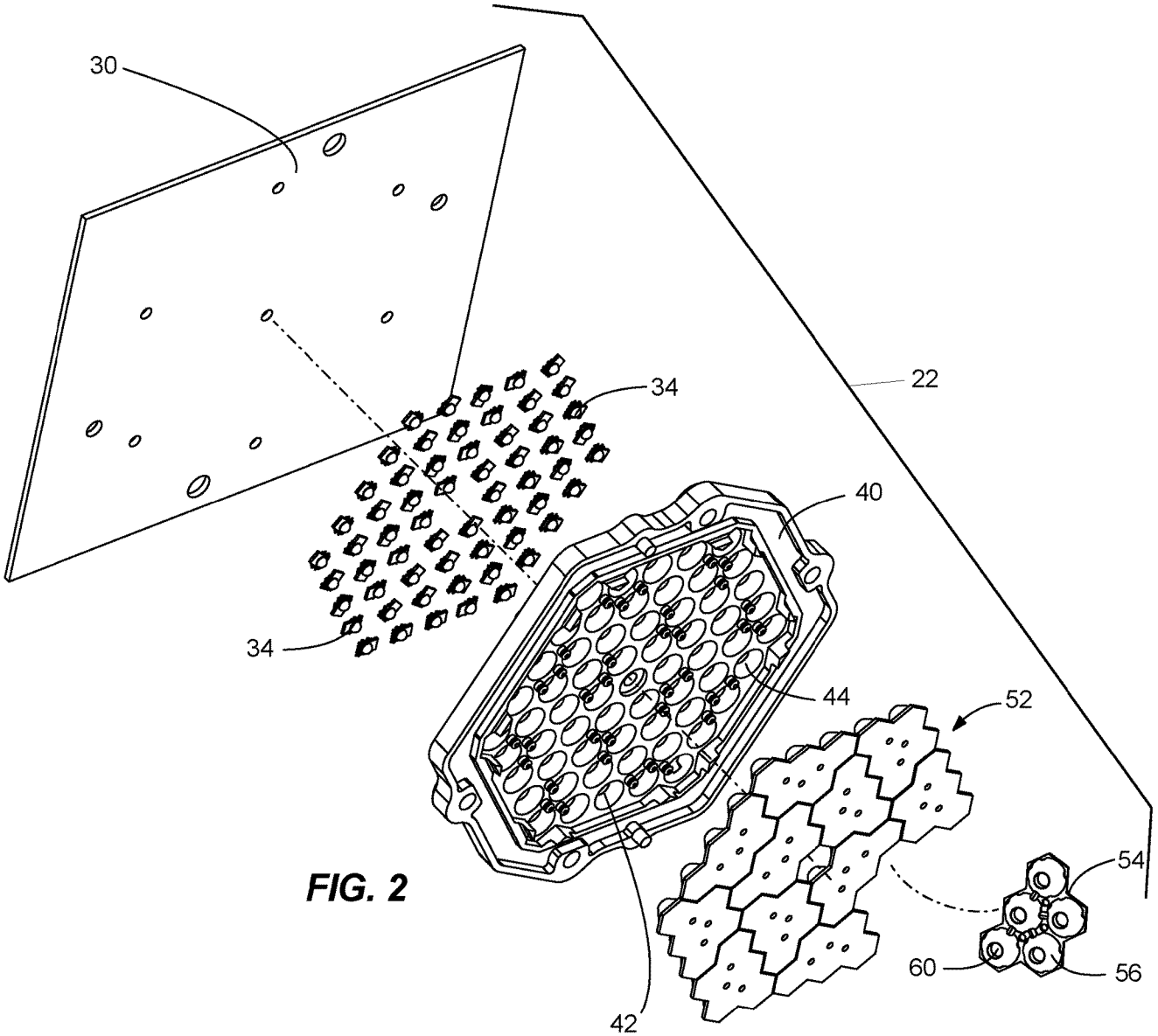
FIG. 2 is an exploded view of the LED light source of FIG. 1.
Figure 3:
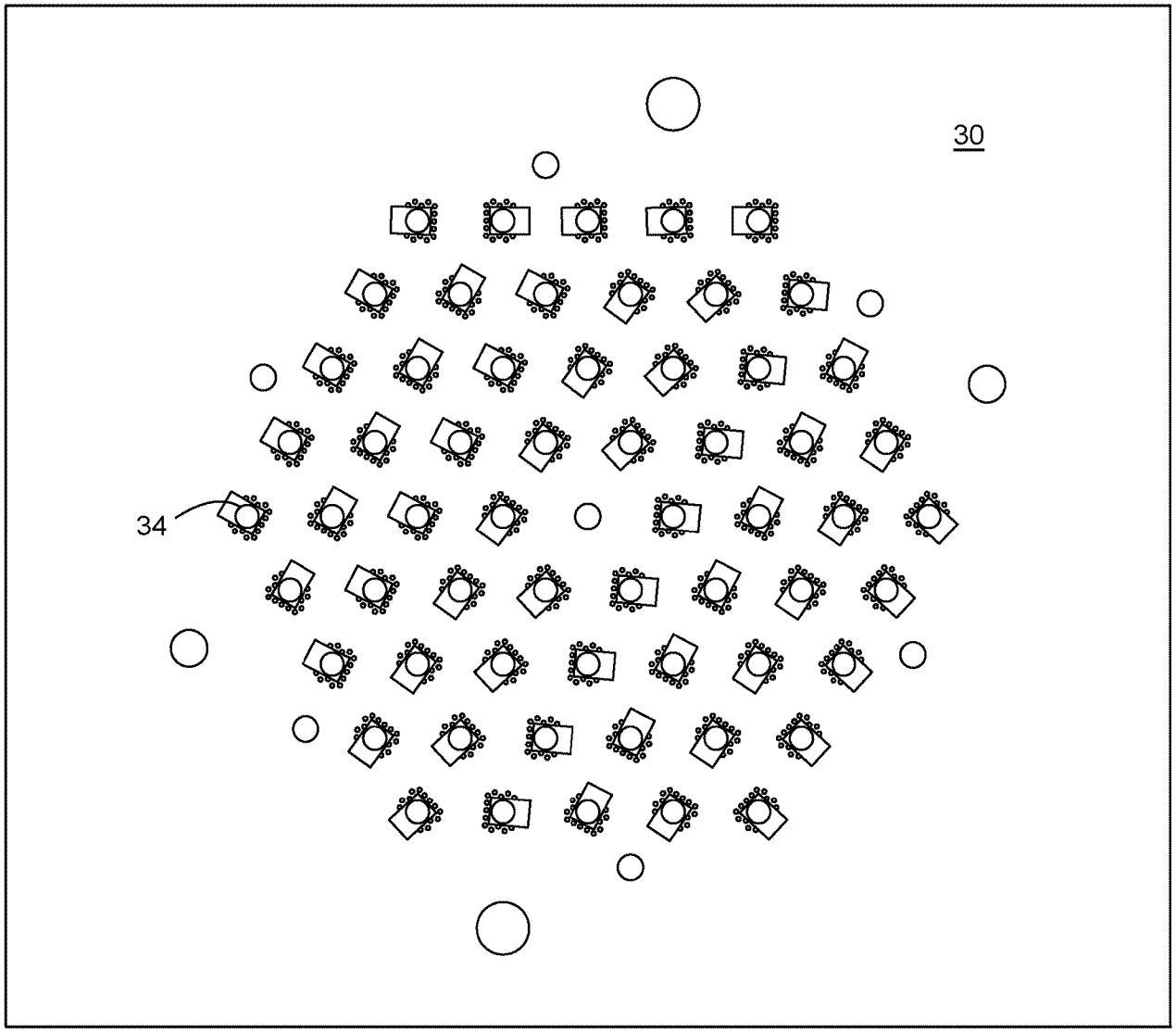
FIG. 3 is a front view of an LED assembly from the light source of FIG. 2.

FIGS. 2-3 illustrate a sample light source 22 comprising an LED assembly that produces light in multiple wave lengths. The LED assembly includes a substrate in the form of a printed circuit board 30 supporting a plurality of the LEDs 34 arranged in a hexagonal array. In the illustrated embodiment, the hexagonal array includes sixty LEDs 34, with five LEDs 34 arranged along each side of the six-sided array. The array is sixty-nine millimeters side-to-side and eighty millimeters corner-to-corner. Each LED 34 is spaced from the adjacent LEDs 34 by a distance of about ten millimeters, and there is no LED at the center of the array. It should be understood that the precise type, number, and positioning of the LEDs can be modified substantially without departing from the teachings of the present invention.

A primary optic holder 40 is mounted on the printed circuit board 30 and includes a series of through holes 42 that are each adapted to receive the corresponding LED 34. Each through hole 42 includes a tapered surface 44 that surrounds the corresponding LED 34. Additional details regarding the light source 22 and the primary optic holder 40 can be found in U.S. Patent Pub. No. US2012/0140463A1, which is hereby incorporated by reference in its entirety.

The light source 22 further includes collimating optics in the form of twelve collimator packs 52 ultrasonically welded to the primary optic holder 40. Each collimator pack 52 includes a back plate 54 and five collimator lenses 56 protruding from the back plate 54 toward the primary optic holder 40. Each collimator lens 56 is positioned in a corresponding through hole 42 of the primary optic holder 40 and includes a parabolic surface that functions to reflect light from the corresponding LED 34 into the mixing assembly 24 by total internal reflection. The surface of the collimator lens 56 is slightly spaced from the tapered surface 44 of the primary optic holder 40. Each collimator lens 56 includes a cylindrical recess 60 that receives the corresponding LED 34. Alternatively, the collimator packs 52 could be formed as a single piece molded glass optic.

The present invention provides an LED luminaire that has the ability to produce a color mix that unexpectedly produces a light mix that results in subjects, particularly human skin tones, looking good to both a human observer and on camera. This is particularly useful when a televised or recorded broadcast includes a live audience.

As used herein, the following colors of LEDs are deemed to produce the dominant wavelengths listed in Table 1 below.

TABLE 1

| Color | Dominant Wavelength, nm Minimum | Maximum |
|---|---|---|
| Deep Red | 651 | 675 |
| Red | 621 | 650 |
| Red-Orange | 610 | 620 |
| Green | 506 | 540 |
| Cyan | 491 | 505 |
| Blue | 451 | 490 |
| Indigo | 420 | 450 |

Table 2 lists examples of bin coordinates for specific phosphor-converted LEDs to produce Amber, Lime, and Mint, although variations in those coordinates are possible.

TABLE 2

| | x1 | y1 | x2 | y2 | x3 | y3 | x4 | y4 |
|---|---|---|---|---|---|---|---|---|
| PC-Amber | 0.5622 | 0.4372 | 0.5576 | 0.4326 | 0.5775 | 0.4132 | 0.5843 | 0.4151 |
| PC-Lime | 0.3819 | 0.5055 | 0.4191 | 0.5790 | 0.4327 | 0.5655 | 0.3972 | 0.4986 |
| PC-Lime | 0.3770 | 0.5080 | 0.3930 | 0.5010 | 0.4290 | 0.5700 | 0.4150 | 0.5830 |
| PC-Mint | 0.3972 | 0.4986 | 0.3830 | 0.5077 | 0.3703 | 0.4825 | 0.3846 | 0.4749 |
| PC-Mint | 0.3846 | 0.4749 | 0.3703 | 0.4825 | 0.3608 | 0.4639 | 0.3752 | 0.4572 |
| PC-Mint | 0.3752 | 0.4572 | 0.3608 | 0.4639 | 0.3515 | 0.4453 | 0.3659 | 0.4396 |
| PC-Mint | 0.3651 | 0.4504 | 0.3679 | 0.4561 | 0.3792 | 0.4437 | 0.3819 | 0.4490 |

The luminaires of the present invention are designed to receive a signal indicating a desired Correlated Color Temperatures (CCTs) (e.g., from 2700K to 6500K) and are programmed to calculate an output composite light spectrum utilizing the spectral power distribution (SPD) of the available light sources. The SPD of each available light source is stored in a memory in the luminaire. The output composite light spectrum is calculated using metamer control to match a desired target spectrum. For example, the target spectrum could be the brightest spectrum, the best spectral (incandescent) spectrum, or any other chosen spectrum. Color matching by metamer control is a generally known process.

For example, U.S. Pat. No. 8,403,523 discloses techniques for maximizing the luminous output of a luminaire while simultaneously minimizing the chromaticity error between an output composite light spectrum and a target light spectrum. U.S. Pat. No. 8,384,294 discloses general techniques for controlling the output of a luminaire to achieve a desired color output for the luminaire. The techniques account for production variations in individual LEDs. U.S. Pat. No. 8,723,450 discloses techniques for controlling the spectral content of the output of a luminaire (i.e., basic metamer control). The techniques allow for individual control of the drive values for particular colors. After increasing or decreasing the amount of a particular color desired in the output spectrum of the luminaire, the drive values of the other colors required to achieve the desired output of the luminaire are recalculated. U.S. Pat. No. 8,593,074 discloses techniques for mimicking the color temperature changes of an ideal black-body radiator based on a target color, a color temperature setting, and an intensity value for the target color. A color temperature transform is then used to determine output drive values for luminaire light sources that achieve the desired output for the luminaire. The four patents referenced earlier in this paragraph provide sufficient disclosure of the use of metamer control to achieve an output composite light spectrum utilizing a known array of light sources, and each of the four patents is hereby incorporated by reference in its entirety for such disclosure.

Table 3 lists the LED color mixes and flux ratios for a first prior art LED luminaire using red, mint, blue, and indigo LEDs. The data provided in the chart represent the field lumens when each color of LEDs is operating at maximum output.

TABLE 3

| Prior Art Color Mix 1 | | |
|---|---|---|
| Color | Field Lumens | Flux Ratio |
| Red | 834 | 8.45% |
| Mint | 8617 | 87.26% |
| Blue | 331 | 3.35% |
| Indigo | 93 | 0.94% |
| | 9875 | |

In order to quantify the color rendering ability of this color mix, virtual experiments were run on the color mix operating to produce white light at various Correlated Color Temperatures (CCTs) from 2700K to 6500K using a best spectral (incandescent) metamer. After the best spectral output was determined for each CCT, the TLCI and TM30 ($R_f$)) were calculated at discrete CCTs using the known calculation engines. The results of these studies for the Prior Art Color Mix 1 are provided in Table 4 below.

TABLE 4

| | CCT, K | TLCI | TM-30 ($R_f$) |
|---|---|---|---|
| Prior Art Color Mix 1 | 2700 | 68.4 | 83 |
| Prior Art Color Mix 1 | 3000 | 90.3 | 91 |
| Prior Art Color Mix 1 | 3200 | 91.8 | 93 |
| Prior Art Color Mix 1 | 4000 | 93.1 | 92 |
| Prior Art Color Mix 1 | 4300 | 91.9 | 89 |
| Prior Art Color Mix 1 | 4500 | 92.2 | 90 |
| Prior Art Color Mix 1 | 5000 | 89.7 | 89 |
| Prior Art Color Mix 1 | 5500 | 87.1 | 89 |
| Prior Art Color Mix 1 | 6000 | 84.7 | 88 |
| Prior Art Color Mix 1 | 6500 | 82.0 | 86 |
| Prior Art Color Mix 1 | 7000 | 79.3 | 85 |

The following Table 5 lists the LED color mixes and flux ratios for a second prior art LED luminaire using red, red-orange, mint, blue, and indigo LEDs. The data provided in the chart represent the field lumens when each color of LEDs is operating at maximum output.

TABLE 5

| Prior Art Color Mix 2 | | |
|---|---|---|
| Color | Field Lumens | Flux Ratio |
| Red | 647 | 7.10% |
| Red-Orange | 1155 | 12.68% |
| Mint | 7144 | 78.41% |
| Blue | 117 | 1.28% |
| Indigo | 48 | 0.53% |
| | 9111 | |

In order to quantify the color rendering ability of this color mix, virtual experiments were run on the color mix in a manner similar to that described above. The results of these studies for the Prior Art Color Mix 2 are provided in Table 6 below.

TABLE 6

| | CCT, K | TLCI | TM-30 ($R_f$) |
|---|---|---|---|
| Prior Art Color Mix 2 | 2950 | 89.0 | 91 |
| Prior Art Color Mix 2 | 3200 | 91.0 | 92 |
| Prior Art Color Mix 2 | 3500 | 92.0 | 92 |
| Prior Art Color Mix 2 | 4000 | 93.0 | 92 |
| Prior Art Color Mix 2 | 4300 | 93.0 | 91 |
| Prior Art Color Mix 2 | 4500 | 92.0 | 91 |
| Prior Art Color Mix 2 | 5000 | 91.0 | 90 |
| Prior Art Color Mix 2 | 5500 | 89.0 | 90 |
| Prior Art Color Mix 2 | 5600 | 89.0 | 90 |
| Prior Art Color Mix 2 | 6000 | 88.0 | 89 |
| Prior Art Color Mix 2 | 6500 | 86.0 | 88 |
| Prior Art Color Mix 2 | 7000 | 83.0 | 87 |

The following Table 7 lists the LED color mixes and flux ratios for a third prior art LED luminaire using red, PC-Amber, lime, green, cyan, blue, and indigo LEDs. The data provided in the chart represent the field lumens when each color of LEDs is operating at maximum output.

TABLE 7

| Prior Art Color Mix 3 | | |
|---|---|---|
| Color | Field Lumens | Flux Ratio |
| Red | 682 | 10.69% |
| PC-Amber | 1,067 | 16.72% |
| Lime | 3,543 | 55.53% |
| Green | 517 | 8.10% |
| Cyan | 440 | 6.90% |
| Blue | 94 | 1.47% |
| Indigo | 37 | 0.58% |
| | 6380 | |

In order to quantify the color rendering ability of this color mix, virtual experiments were run on the color mix in a manner similar to that described above. The results of these studies for the Prior Art Color Mix 3 are provided in Table 8 below.

TABLE 8

| | CCT, K | TLCI | TM-30 ($R_f$) |
|---|---|---|---|
| Prior Art Color Mix 3 | 2700 | 86.8 | 93 |
| Prior Art Color Mix 3 | 3000 | 88.8 | 93 |
| Prior Art Color Mix 3 | 3200 | 89.9 | 93 |
| Prior Art Color Mix 3 | 4000 | 90.2 | 93 |
| Prior Art Color Mix 3 | 4300 | 91.3 | 92 |
| Prior Art Color Mix 3 | 4500 | 91.3 | 93 |
| Prior Art Color Mix 3 | 5000 | 92.0 | 93 |
| Prior Art Color Mix 3 | 5500 | 89.1 | 92 |
| Prior Art Color Mix 3 | 6000 | 93.5 | 94 |
| Prior Art Color Mix 3 | 6500 | 94.0 | 93 |
| Prior Art Color Mix 3 | 7000 | 94.5 | 93 |

The present invention recognizes the enhanced rendering of skin tones achieved by the strategic use of deep red light combined with lime/mint light. The colors lime and mint are being grouped for this purpose because it has been found that either lime or mint can achieve the desired results. In this regard, unless otherwise stated, reference to "lime/mint" shall include any LED having bin coordinates that fall with the range set forth in Table 9.

TABLE 9

| | x1 | y1 | x2 | y2 | x3 | y3 | x4 | y4 |
|---|---|---|---|---|---|---|---|---|
| Lime/Mint | 0.3210 | 0.3874 | 0.4191 | 0.5790 | 0.4400 | 0.5655 | 0.3494 | 0.3842 |

Similarly, the colors red and red-orange are being grouped because it has been found that either red or red/orange can achieve the desired results. In this regard, reference to "red/red-orange" is intended to cover any light that falls within the dominant wavelength ranges defined for red or red-orange above. Similarly, the colors blue and indigo are being grouped because it has been found that either blue or indigo can achieve the desired results. In this regard, reference to "blue/indigo" is intended to cover any light that falls within the dominant wavelength ranges defined for blue or indigo above.

The following tables list the color mixes of three different LED luminaires embodying aspects of the present invention, and separate tables that provide the calculated TLCI and TM-30 ($R_f$) numbers for multiple CCTs. It is noted that each includes some amount of deep red and also a relatively large amount of lime/mint. The color mix tables 10, 12, and 14 provide the total (full power) lumens for each color and the ratios of each color to the total (full power) lumens of the luminaire.

TABLE 10

| Example Color Mix 1 | | | |
|---|---|---|---|
| LED Color | Number of LEDs | Lumens | Ratio |
| Deep Red | 8 | 279.44 | 1.25% |
| Red | 12 | 1259.76 | 5.65% |
| Red-Orange | | | |
| PC Amber | | | |
| Mint | 46 | 19109.78 | 85.71% |
| Cyan | 6 | 835.08 | 3.75% |
| Blue | 8 | 642 | 2.88% |
| Indigo | 4 | 171.08 | 0.77% |

As was done with the prior art color mixes, in order to quantify the color rendering ability of this color mix, virtual experiments were run on the color mix in a manner similar to that described above. The results of these studies for the Example Color Mix 1 are provided in Table 11 below.

TABLE 11

| | CCT, K | TLCI | TM-30 ($R_f$) |
|---|---|---|---|
| Example Color Mix 1 | 2700 | 59.9 | 81 |
| Example Color Mix 1 | 3000 | 88.3 | 89 |
| Example Color Mix 1 | 3200 | 92.6 | 92 |
| Example Color Mix 1 | 4000 | 96.4 | 92 |
| Example Color Mix 1 | 4300 | 97.4 | 93 |
| Example Color Mix 1 | 4500 | 97.6 | 93 |
| Example Color Mix 1 | 5000 | 98.2 | 94 |
| Example Color Mix 1 | 5500 | 97.1 | 94 |
| Example Color Mix 1 | 6000 | 98.1 | 95 |
| Example Color Mix 1 | 6500 | 98.8 | 95 |
| Example Color Mix 1 | 7000 | 99.0 | 95 |

TABLE 12

| Example Color Mix 2 | | | |
|---|---|---|---|
| LED Color | Number of LEDs | Lumens | Ratio |
| Deep Red | 8 | 279.44 | 1.36% |
| Red | | | |
| Red-Orange | 12 | 1673.28 | 8.16% |
| PC Amber | 6 | 1364.52 | 6.65% |
| Mint | 36 | 14955.48 | 72.93% |
| Cyan | 12 | 1670.16 | 8.14% |
| Blue | | | |
| Indigo | 10 | 563.5 | 2.75% |

As was done with the prior art color mixes, in order to quantify the color rendering ability of this color mix, virtual experiments were run on the color mix in a manner similar to that described above. The results of these studies for the Example Color Mix 2 are provided in Table 13 below.

TABLE 13

| | CCT, K | TLCI | TM-30 ($R_f$) |
|---|---|---|---|
| Example Color Mix 2 | 2700 | 87.8 | 90 |
| Example Color Mix 2 | 3000 | 73.5 | 88 |
| Example Color Mix 2 | 3200 | 92.2 | 92 |
| Example Color Mix 2 | 4000 | 93.8 | 94 |
| Example Color Mix 2 | 4300 | 93.9 | 93 |

TABLE 13-continued

| | CCT, K | TLCI | TM-30 ($R_f$) |
|---|---|---|---|
| Example Color Mix 2 | 4500 | 94.3 | 95 |
| Example Color Mix 2 | 5000 | 95.1 | 95 |
| Example Color Mix 2 | 5500 | 94.5 | 94 |
| Example Color Mix 2 | 6000 | 94.7 | 94 |
| Example Color Mix 2 | 6500 | 96.4 | 94 |
| Example Color Mix 2 | 7000 | 96.5 | 94 |

TABLE 14

| Example Color Mix 3 | | | |
|---|---|---|---|
| LED Color | Number of LEDs | Lumens | Ratio |
| Deep Red | 10 | 348.7 | 2.08% |
| Red | 16 | 1679.68 | 10.02% |
| Red-Orange | | | |
| PC Amber | 8 | 1819.36 | 10.85% |
| Lime | 23 | 9579.5 | 57.14% |
| Green | 7 | 1368.78 | 8.16% |
| Cyan | 10 | 1391.8 | 8.30% |
| Blue | 4 | 321 | 1.91% |
| Indigo | 6 | 256.62 | 1.53% |

As was done with the prior art color mixes, in order to quantify the color rendering ability of this color mix, virtual experiments were run on the color mix in a manner similar to that described above. The results of these studies for the Example Color Mix 3 are provided in Table 15 below.

TABLE 15

| | CCT, K | TLCI | TM-30 ($R_f$) |
|---|---|---|---|
| Example Color Mix 3 | 2950 | 96.0 | 93 |
| Example Color Mix 3 | 3200 | 97.0 | 94 |
| Example Color Mix 3 | 3500 | 98.0 | 94 |
| Example Color Mix 3 | 4000 | 99.0 | 94 |
| Example Color Mix 3 | 4300 | 99.0 | 93 |
| Example Color Mix 3 | 4500 | 99.0 | 93 |
| Example Color Mix 3 | 5000 | 99.0 | 94 |
| Example Color Mix 3 | 5500 | 99.0 | 95 |
| Example Color Mix 3 | 5600 | 99.0 | 94 |
| Example Color Mix 3 | 6000 | 99.0 | 94 |
| Example Color Mix 3 | 6500 | 99.0 | 94 |
| Example Color Mix 3 | 7000 | 99.0 | 94 |

Table 16 provides data regarding the emitter drive condition (percentage of full) for each group of LEDs of Example Color Mix 3 to emit white light at several different color temperatures using the best spectral metamer calculation. The corresponding Yfrac (relative intensity compared to all emitters at full power), CRI, TLCI, and TM-30 ($R_f$), are provided for each color temperature.

TABLE 16

| CCT | Deep Red (%) | Red (%) | Amber (%) | Lime (%) | Green (%) | Cyan (%) | Blue (%) | Indigo (%) | Yfrac (%) | TLCI | TM-30 ($R_f$) |
|---|---|---|---|---|---|---|---|---|---|---|---|
| 2700 | 100 | 0 | 40.88 | 23.87 | 0 | 12.56 | 18.55 | 6.31 | 19.97 | 96 | 93 |
| 3000 | 100 | 0 | 44.81 | 29.1 | 0 | 18.73 | 26.32 | 10.04 | 23.44 | 97 | 94 |
| 3200 | 100 | 0 | 45.93 | 32.86 | 0 | 22.78 | 32.13 | 13.01 | 25.69 | 97 | 94 |
| 4000 | 100 | 0 | 49.99 | 46.45 | 1.73 | 40.56 | 58.33 | 28.9 | 34.31 | 99 | 94 |
| 5600 | 86.47 | 0 | 47.3 | 58.29 | 9.42 | 64.89 | 100 | 61.02 | 42.24 | 99 | 94 |
| 6500 | 68.6 | 0 | 39.14 | 52.3 | 11.3 | 63.7 | 100 | 66.15 | 38.1 | 99 | 94 |

Table 17 provides data regarding the emitter drive condition (percentage of full) for each group of LEDs of Example Color Mix 3 to emit white light at several different color temperatures using the brightest metamer calculation. The corresponding Yfrac (relative intensity compared to all emitters at full power), TLCI, and TM-30 ($R_f$) are provided for each color temperature.

TABLE 17

| CCT | Deep Red (%) | Red (%) | Amber (%) | Lime (%) | Green (%) | Cyan (%) | Blue (%) | Indigo (%) | Yfrac (%) | TLCI | TM-30 ($R_f$) |
|---|---|---|---|---|---|---|---|---|---|---|---|
| 2700 | 100 | 100 | 100 | 100 | 100 | 74.27 | 0.00 | 57.27 | 97.01 | 64 | 81 |
| 3000 | 41.79 | 100 | 100 | 100 | 100 | 100 | 100 | 39.02 | 98.23 | 69 | 80 |
| 3200 | 0 | 94.01 | 100 | 100 | 100 | 100 | 100 | 50.80 | 96.28 | 73 | 83 |
| 4000 | 0 | 62.09 | 100 | 100 | 100 | 100 | 100 | 95.18 | 90.75 | 85 | 90 |
| 5600 | 100 | 38.20 | 0 | 69.47 | 100 | 100 | 100 | 100 | 60.88 | 53 | 78 |
| 6500 | 100 | 30.90 | 0 | 54.48 | 100 | 100 | 100 | 100 | 52.50 | 44 | 74 |

Figure 4:
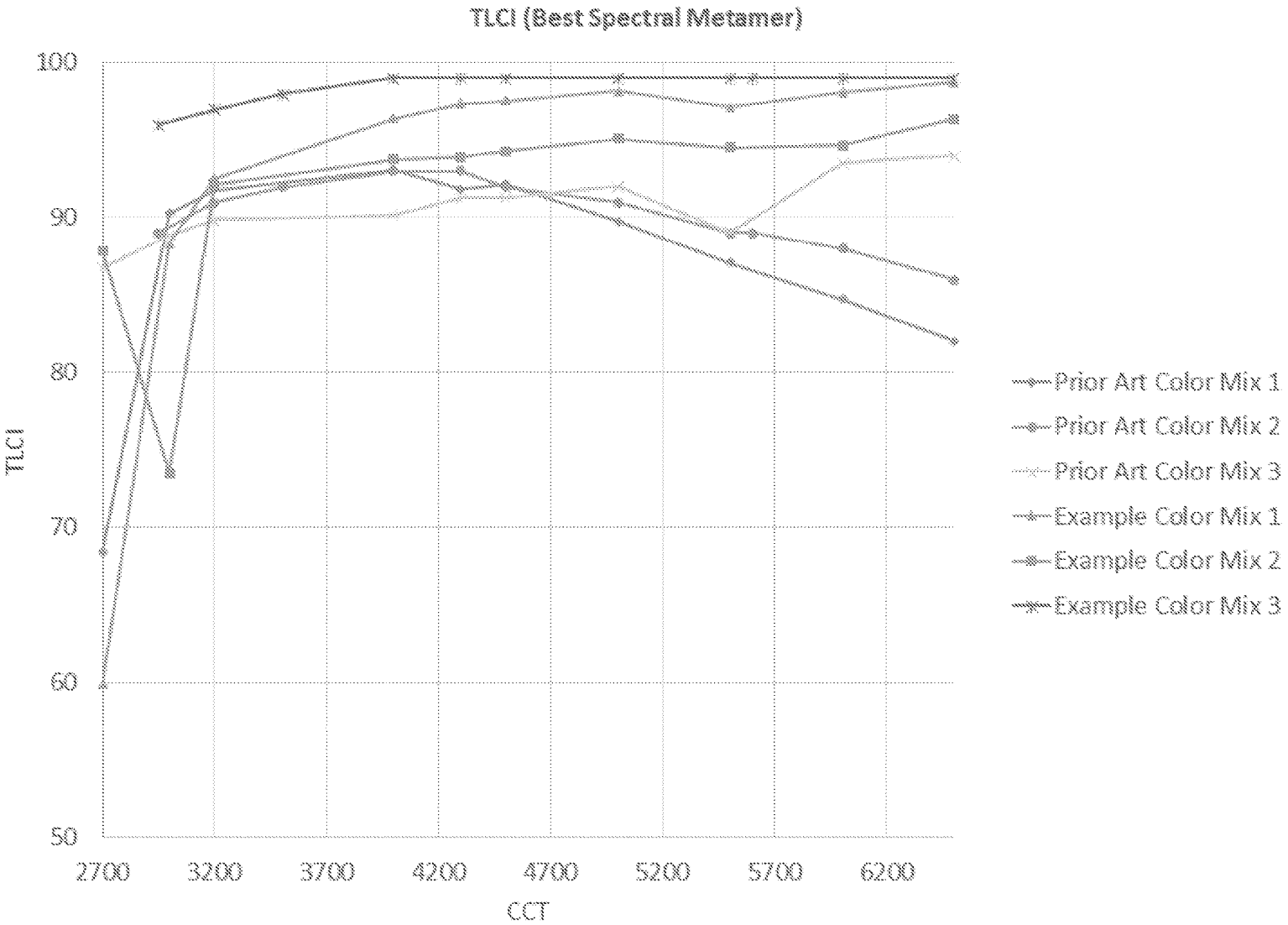
FIG. 4 is a graph comparing the TLCI numbers for the prior art mixes and examples described in the specification using a best spectral metamer.
Figure 5:
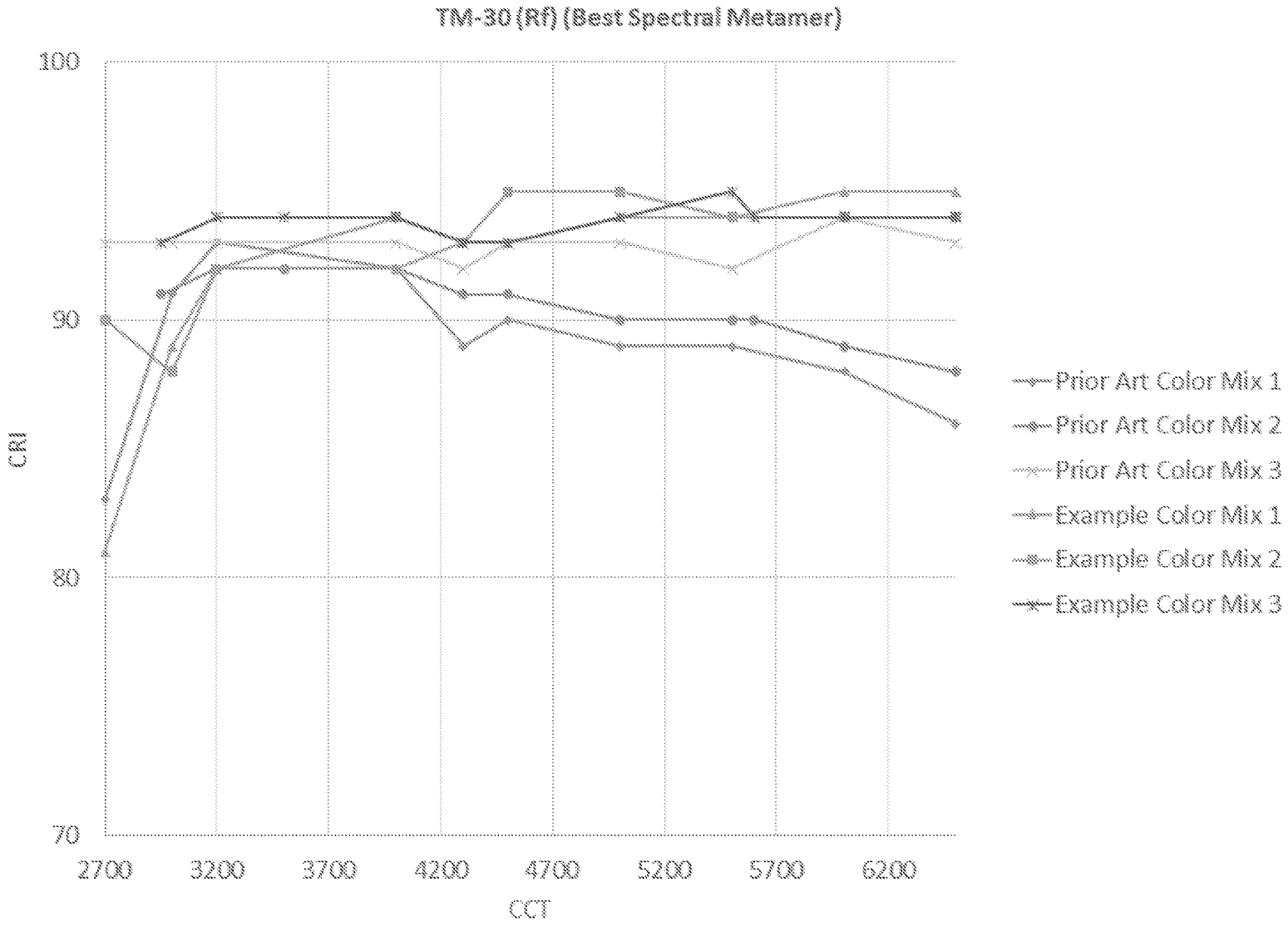
FIG. 5 is a graph comparing the TM-30 ($R_f$) numbers for the prior art mixes and examples described in the specification using a best spectral metamer.

The above-referenced TLCI and TM-30 ($R_f$) numbers for each of the six color mixes discussed above are illustrated in relation to each other in the graphs of FIG. 4 and FIG. 5, respectively.

Using the above Example color mixes, it was observed that skin tone rendering was good under both stage conditions (i.e., viewed by human eye) and studio conditions (i.e., view through a camera), compared to the prior art color mixes. It is believed that the use of deep red combined with lime/mint in the color mixes results in the good skin tone rendering under both stage and studio conditions.

Various features and advantages of the invention are set forth in the following claims.

The invention claimed is:

1. An LED light fixture having a total lumen output, comprising:
- a substrate; and
- a plurality of LEDs mounted on the substrate and capable of producing a total lumen output when operated at full power, the plurality of LEDs including:
  - a lime/mint light source accounting for at least 25% of the total lumen output; and
  - a deep red light source having a dominant wavelength of 651 nm-675 nm and accounting for at least 0.5% of total lumen output.

2. An LED light fixture as claimed in claim 1, wherein the lime/mint light source accounts for at least 35% of the total lumen output.

3. An LED light fixture as claimed in claim 1, wherein the deep red light source accounts for at least 0.75% of the total lumen output.

4. An LED light fixture as claimed in claim 1, further comprising a cyan light source that accounts for 1% to 50% of the total lumen output.

5. An LED light fixture as claimed in claim 4, wherein the cyan light source account for 1% to 30% of the total lumen output.

6. An LED light fixture as claimed in claim 1, further comprising a red/red-orange light source that accounts for 1% to 20% of the total lumen output.

7. An LED light fixture as claimed in claim 6, wherein the red/red-orange light source accounts for 3% to 12% of the total lumen output.

8. An LED light fixture as claimed in claim 1, further comprising a blue/indigo light source that accounts for 1% to 10% of the total lumen output.

9. An LED light fixture as claimed in claim 8, wherein the blue/indigo light source accounts for 2% to 5% of the total lumen output.

10. An LED light fixture comprising:
- a substrate;
- a plurality of LEDs mounted on the substrate and capable of producing a total lumen output when operated at full power, the plurality of LEDs including:
  - a lime/mint light source accounting for at least 25% of the total lumen output,
  - a deep red light source having a dominant wavelength of 651 nm-675 nm and accounting for at least 0.5% of total lumen output,
  - a cyan light source accounting for at least 1% of the total lumen output;
  - a red/red-orange light source accounting for at least 1% of the total lumen output;
  - a blue/indigo light source accounting for at least 1% of the total lumen output;
- a processor for calculating a color mix and driving the LEDs, wherein the processor is programmed to produce a color mix having a CCT in the range of 2700-6500K, a TM-30 ($R_f$) of at least 90, and a TLCI of at least 95.

11. An LED light fixture as claimed in claim 10, wherein the lime/mint light source accounts for at least 35% of the total lumen output.

12. An LED light fixture as claimed in claim 10, wherein the deep red light source accounts for at least 0.75% of the total lumen output.

13. An LED light fixture as claimed in claim 10, wherein the cyan light source account for 2% to 30% of the total lumen output.

14. An LED light fixture as claimed in claim 10, wherein the red/red-orange light source accounts for 2% to 12% of the total lumen output.

15. An LED light fixture as claimed in claim 10, wherein the blue/indigo light source accounts for 2% to 5% of the total lumen output.

16. An LED light fixture comprising:
- a substrate;
- a plurality of LEDs mounted on the substrate and capable of producing a total lumen output when operated at full power, the plurality of LEDs including:
  - a lime/mint light source accounting for at least 25% of the total lumen output, and
  - a deep red light source having a dominant wavelength of 651 nm-675 nm and accounting for at least 0.5% of total lumen output;
- a processor for calculating a color mix and driving the LEDs, wherein the processor is programmed to produce a color mix having a CCT in the range of 2700-6500K, a TM-30 ($R_f$) of at least 90, and a TLCI of at least 95.

17. An LED light fixture as claimed in claim 16, wherein the lime/mint light source accounts for at least 35% of the total lumen output.

18. An LED light fixture as claimed in claim 16, wherein the deep red light source accounts for at least 0.75% of the total lumen output.

19. An LED light fixture as claimed in claim 16, wherein the color mix has a CCT of about 6500K, a TM-30 ($R_f$) of at least 92, and a TLCI of at least 95.

20. An LED light fixture as claimed in claim 16, wherein the color mix has a CCT of about 5000K, a TM-30 ($R_f$) of at least 92, and a TLCI of at least 95.

* * * * *